US007475792B2

(12) United States Patent
Hansen

(10) Patent No.: US 7,475,792 B2
(45) Date of Patent: Jan. 13, 2009

(54) HOT BEVERAGE CONTAINER

(76) Inventor: David Scott Hansen, 117 Thurston Ave., Apt. 4, Ithaca, NY (US) 14850

( * ) Notice: Subject to any disclaimer, the term of this patent is extended or adjusted under 35 U.S.C. 154(b) by 411 days.

(21) Appl. No.: 11/425,900

(22) Filed: Jun. 22, 2006

(65) Prior Publication Data

US 2007/0187418 A1 Aug. 16, 2007

Related U.S. Application Data

(60) Provisional application No. 60/766,787, filed on Feb. 11, 2006.

(51) Int. Cl.
*B65D 25/06* (2006.01)
*B65D 83/34* (2006.01)
*B65D 83/14* (2006.01)
*B65D 90/06* (2006.01)

(52) U.S. Cl. ..... 220/592.26; 220/495.03; 220/675; 220/709

(58) Field of Classification Search ..... 220/592.26, 220/495.03, 675, 705, 707, 709
See application file for complete search history.

(56) References Cited

U.S. PATENT DOCUMENTS 2,013,475 A 9/1935 Orton
2,885,134 A 5/1959 Cohen
3,332,567 A 7/1967 Pugh, Sr.
4,191,302 A * 3/1980 Fiducia ..... 220/705
4,291,814 A 9/1981 Conn
D269,659 S 7/1983 Holloway
4,428,490 A 1/1984 Holloway
4,442,948 A 4/1984 Levy et al.
D279,250 S 6/1985 Holloway
4,684,032 A * 8/1987 Tsay ..... 215/389
4,830,204 A 5/1989 Lin
4,915,250 A * 4/1990 Hayes, Jr. ..... 220/711
5,005,717 A 4/1991 Oilar
5,030,831 A * 7/1991 Coon et al. ..... 250/370.14
5,054,631 A 10/1991 Robbins, III
5,253,780 A 10/1993 Adado
5,415,002 A * 5/1995 Koenig ..... 62/63
D360,558 S 7/1995 Appleman
5,439,125 A * 8/1995 Bloch ..... 215/229
5,961,004 A 10/1999 DeMars
5,964,379 A 10/1999 DeMars
6,176,390 B1 1/2001 Kemp
6,318,584 B1 11/2001 Milan
6,336,566 B1 1/2002 Lipson
6,419,111 B1 * 7/2002 Kepner ..... 220/705
6,471,085 B1 10/2002 Gallo
6,488,173 B2 12/2002 Milan
6,550,631 B2 * 4/2003 Thompson ..... 220/709
7,021,490 B2 4/2006 Lipson
7,156,255 B2 * 1/2007 Raft ..... 220/603

(Continued)

*Primary Examiner*—Anthony D Stashick
*Assistant Examiner*—Niki M Eloshway
(74) *Attorney, Agent, or Firm*—Brown & Michaels, PC

(57) ABSTRACT

A beverage container having an inner core and an outer shell, relatively rotatable such that a spiral groove in the inner core can be rotationally aligned with cooling flanges on the outside of the outer shell for cleaning, or rotated to close the cooling flanges, forming a cooling tube from the inside of the inner core to a drinking tube at the top of the container, thereby cooling a beverage that is drawn through the cooling flanges by radiating heat into the ambient environment.

9 Claims, 7 Drawing Sheets

U.S. PATENT DOCUMENTS

2002/0166865 A1* 11/2002 Miorelli ..... 220/719
2006/0248910 A1* 11/2006 Smolko et al. ..... 62/315
2007/0084871 A1* 4/2007 Lipson ..... 220/705

* cited by examiner

HOT BEVERAGE CONTAINER

REFERENCE TO RELATED APPLICATIONS

This application claims an invention which was disclosed in Provisional Application No. 60/766,787, filed Feb. 11, 2006, entitled "Never Too Hot Mug". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of hot beverage containers. More particularly, the invention pertains to hot beverage containers that cool the liquid prior to consumption.

2. Description of Related Art

When I have made hot coffee, hot chocolate, or hot tea in the past I have always been annoyed that I had to wait several minutes until my beverage cools down. What should be a pleasant experience is marred by the need to take scalding test sips, or alternatively risk waiting too long and resulting in cold coffee. Having found no reusable mugs with such features, I was challenged to find a way to both keep the beverage hot, yet still allow for comfortable drinking immediately.

U.S. Pat. Nos. 6,488,173, 6,471,085, 6,318,584, 6,176,390, 5,964,379, 5,961,004, and 5,253,780 display methods of cooling a hot beverage by separating a portion of a hot beverage into cooling chambers where the beverage cools at a more rapid pace. These methods do not allow for immediate and continuous consumption allowed by my invention. Furthermore, they are significantly more complex and expensive to use or manufacture, two of them even incorporating valve systems.

U.S. Pat. Nos. 7,021,490, D360,558, U.S. Pat. Nos. 5,054,631, 5,005,717, 4,830,204, D279,250, U.S. Pat. Nos. 4,442,948, 4,428,490, D269,659, U.S. Pat. Nos. 4,291,814, 3,332,567, 2,885,134, and 2,013,475 display combinations of straws and drinking vessels. However, these designs suffer from one or more of the following deficiencies: lack sufficient straw length to cool a liquid, the tubes are not designed to maximize cooling, the tubes are permanently enclosed making cleaning impractical, require disassembly to clean, the tubes are arranged in vertical loops requiring additional sucking before beverage is consumed, and are not designed to hold hot beverages.

U.S. Pat. No. 4,442,948 is similar to an embodiment of my invention, but does not allow cleaning without disassembly. The articles described in U.S. Pat. No. 4,442,948 require removal of the inner cup to expose the tubing for cleaning, which in addition to being an extra step, adds risk of losing a piece and rendering the whole mug useless.

SUMMARY OF THE INVENTION

A beverage container which draws hot beverage from the insulated interior, through a tube network along the exterior of the cup, up to the rim of the cup, thereby cooling the beverage that is sucked through the tube network by radiating heat into the ambient environment. The preferred embodiment consists of two parts, such that the insulated interior core can be rotated in relation to the outer cup resulting in either an enclosed tube which can be used to draw liquid from the interior of the cup as described above, or exposure of the cooling flanges for cleaning.

Through this design, one can have an inexpensive, reusable, and easily cleaned mug that allows immediate and continuous consumption of hot beverages. Furthermore, by allowing immediate consumption without cooling the entire beverage at once, the window of optimal temperature for consumption is expanded. Once the beverage cools to the point that the tube cooling system is unnecessary, the cup can be sipped from in a normal fashion.

DETAILED DESCRIPTION OF THE INVENTION

Figure 3:
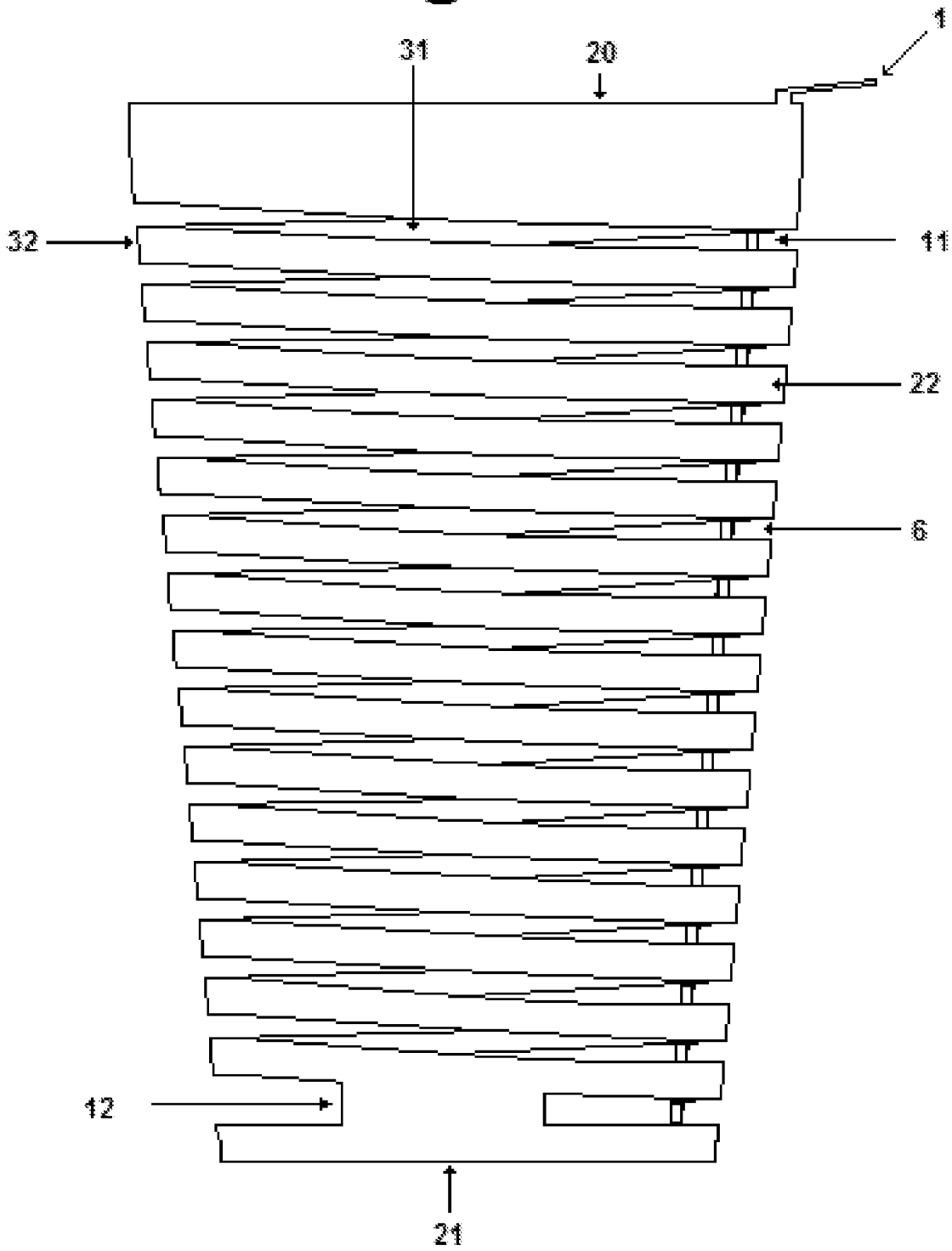
FIG. 3 shows a view of the inner core of the invention.
Figure 4:
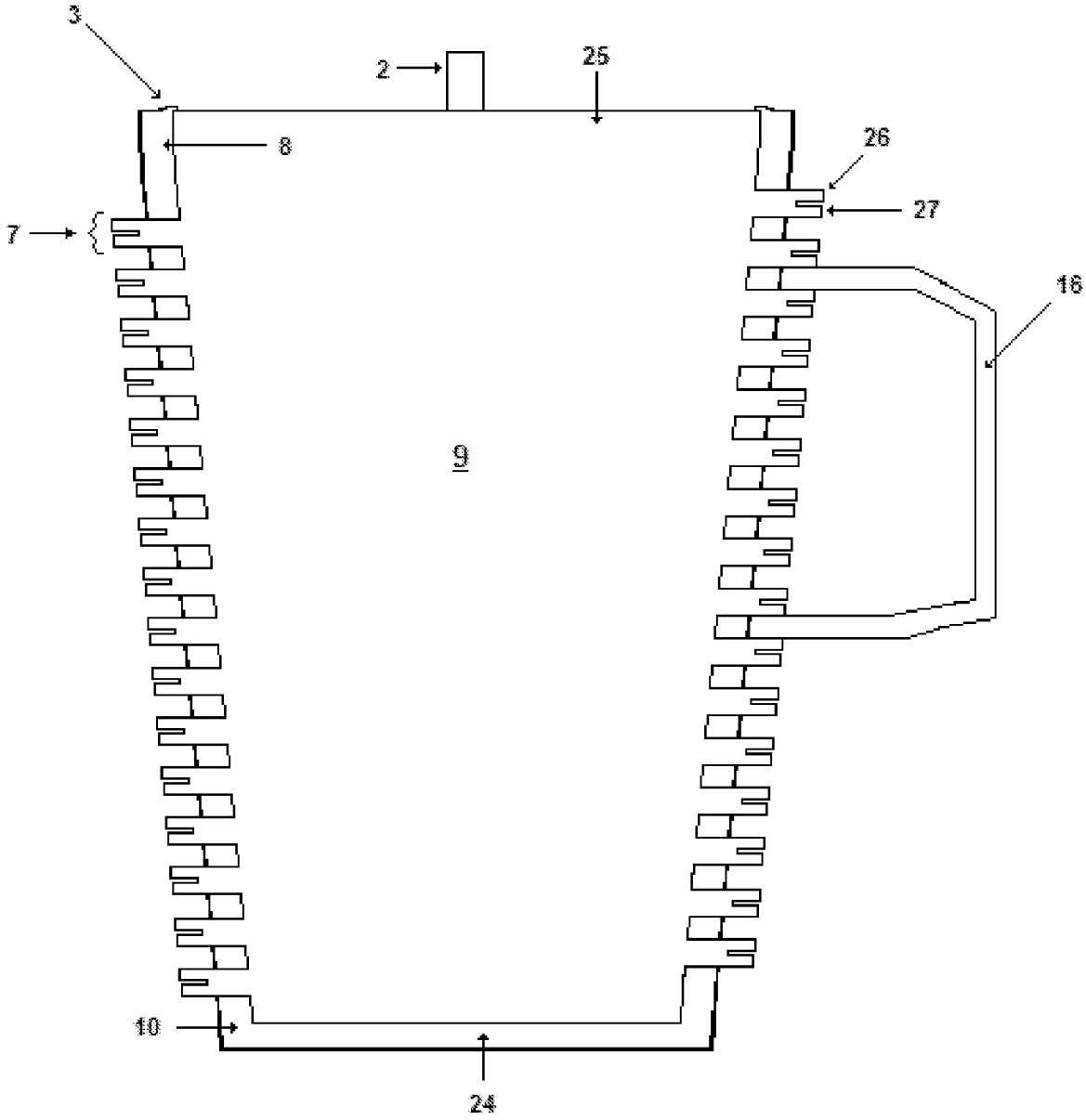
FIG. 4 shows a cross section of the exterior cup

The beverage container of the invention is designed to overcome the shortcomings described in the prior art. It is a drinking container formed from two main parts—an inner core (4), shown separately in FIG. 3, and an outer shell (10), shown separately in FIG. 4. The other figures show the assembled cup, made up of the inner core (4) inside the outer shell (10).

Referring to the figures, the first par of the container is an inner core (4) with an open top (20), an open (as drawn) or closed bottom (21), and side walls (22) enclosing a central chamber (23). The inner core (4) is roughly cylindrical with a long gap (6) spiraling down from the inner surface (31) of the side walls (22) through to the outer surface (32) of the side walls (22), from the top (20) to the bottom (21). At the bottom (21) is a large gap (5) on both sides of the core (4) connected on the sides (12) such that the bottom tubing is exposed regardless of whether it is in consumption or cleaning orientation. Preferably, the inner core (4) is made of insulating material Optionally, one or more stabilizing rods (11) are attached to the interior wall (22) of the inner core (4) in order to hold the core together. This is not necessary if the insulation of which the inner core is made is constructed of sufficiently rigid materials. At the top (20) is a large tab (1) that extends over the rim of the cup. This allows for easy manipulation of how the interior core (4) is aligned with the outer shell (8).

The second main part of the invention is the outer shell (10). The outer shell (10) has an open top (25), a bottom (24), and walls (8), The walls are preferably insulated, enclosing a generally cylindrical central chamber (9) which is shaped and sized to tightly surround outer surface (32) of the inner core (4).

Figure 5:
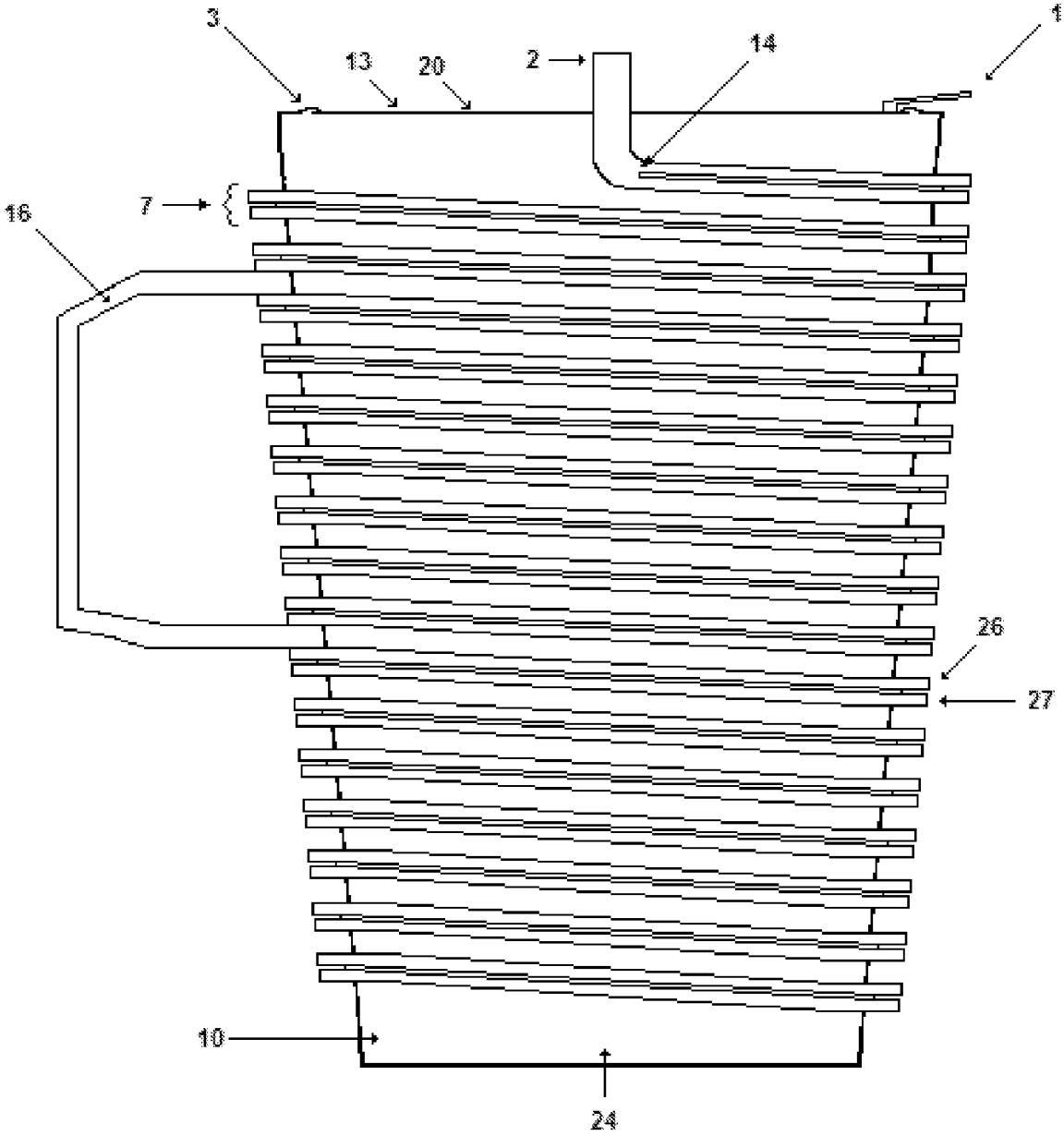
FIG. 5 shows an exterior rear view of the invention with the tip structure.
Figure 6:
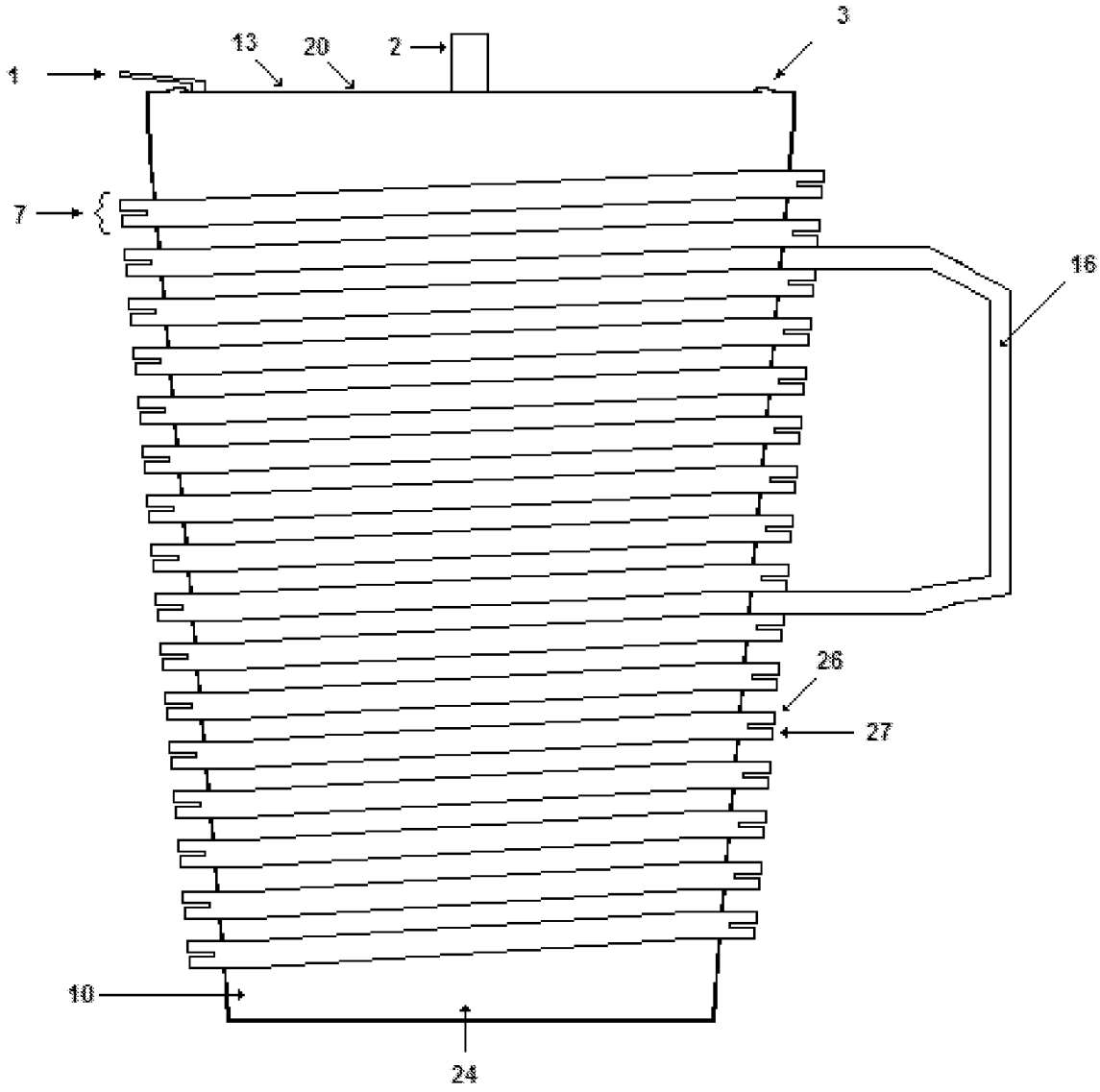
FIG. 6 shows an exterior view of opposite side of the invention from FIG. 5
Figure 7:
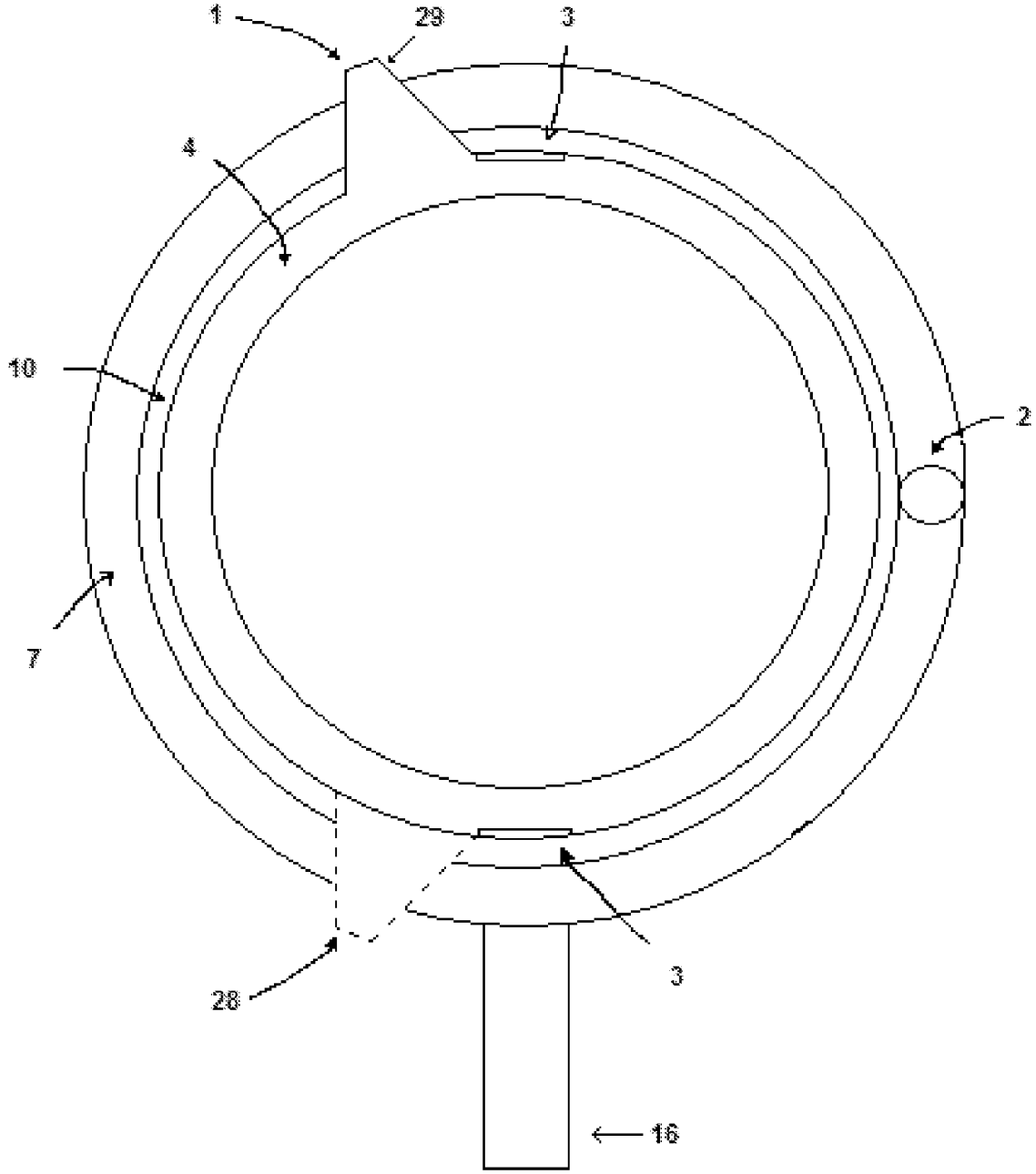
FIG. 7 shows a top view of the invention with tip structure.

The walls (8) have non-insulated cooling flanges (7) spiraling up the walls to the open top (20) at the same rate as the gap (6) of the inner core (4), so that the flanges (7) and gap (6) can be aligned, as described in detail below. The flanges (7) are preferably divided into pairs (26) and (27) with the combined diameter slightly larger than gap (6) of the inner core (4), in order to present more surface area for cooling. Other arrangements with three or more divisions might be possible. As shown in FIG. 5, if the flange (7) is divided into two or more parallel cooling flanges, the cooling flange divisions (26) and (27) will preferably merge into one tube (2) at a point (14) immediately prior to reaching the rim of the mug (13). This tube (2) then protrudes above the top (20) of the container.

The outer shell (10) also has at least one handle (16) protruding from one side. This handle can either be molded as part of the outer shell (10) or can be attached from a separate piece.

The outer surface (32) of the inner core (4) and the central chamber (9) of the outer shell (10) are generally cylindrical and sized such that the inner core (4) fits tightly within the outer shell (10), but is free to rotate. In most applications it is likely that the inner surface (31) of the inner core (4) and the outside of the outer shell (10) will also be generally cylindrical, but other shapes would be possible within the teachings of the invention. In the context of this description, the term "cylindrical" will be understood to include cylinders with parallel walls and tapered cylinders as shown in the drawings.

Figure 1:
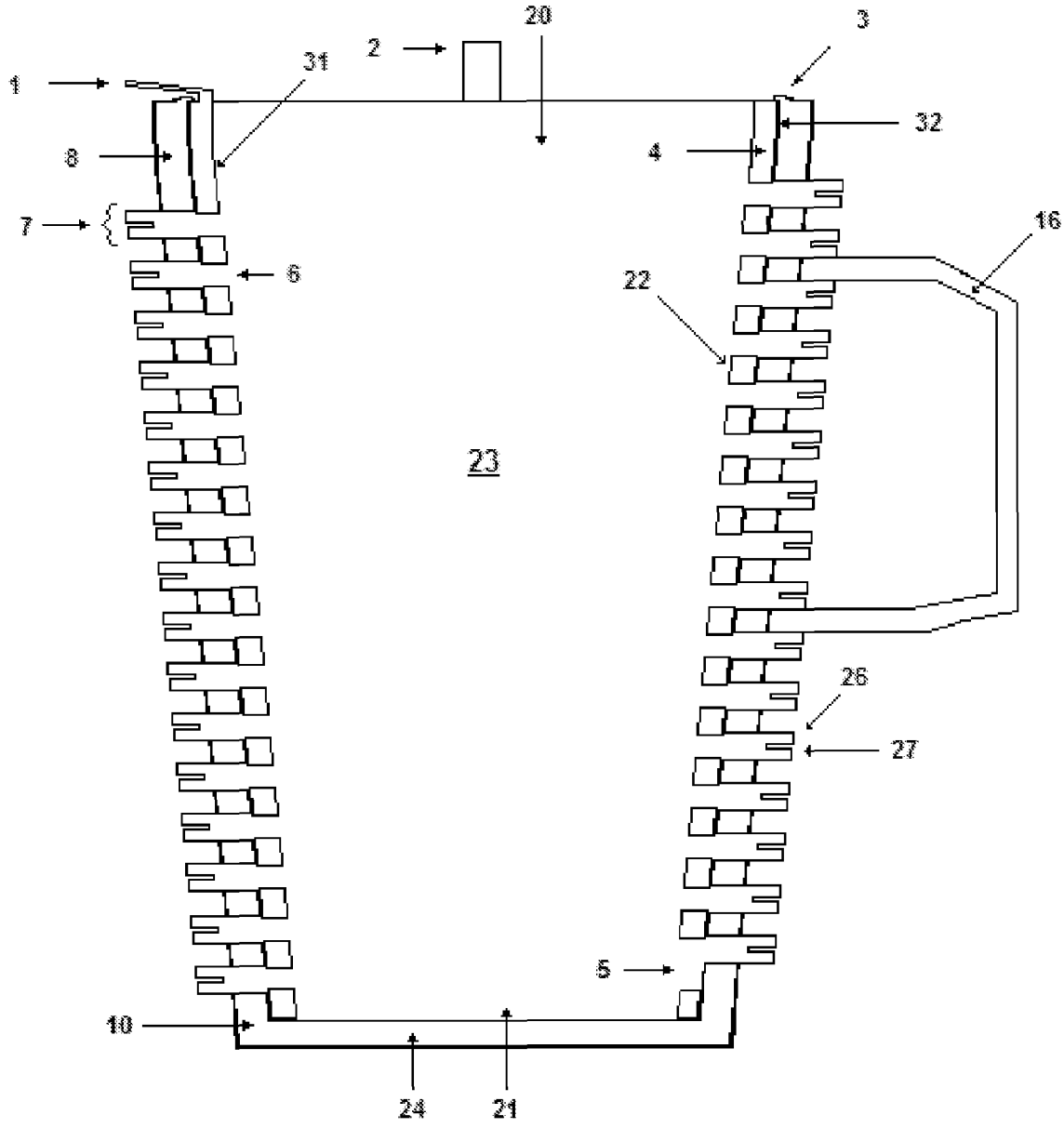
FIG. 1 shows a cross section of the invention in cleaning orientation, with the tubes open.
Figure 2:
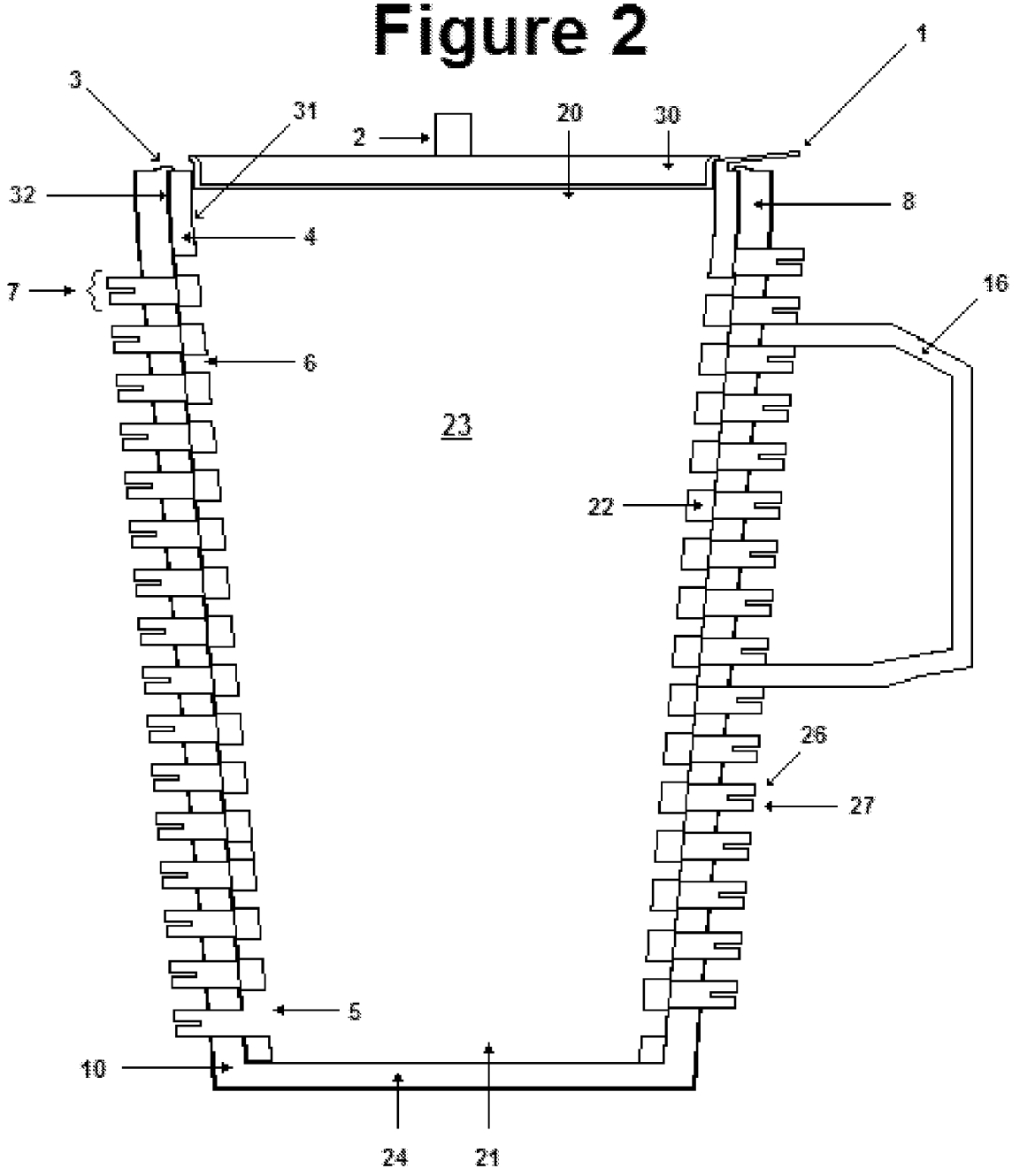
FIG. 2 shows a cross section of the invention in consumption orientation, with the tubes sealed.

Finally, at the top (25) of the outer shell (10) are two small tabs (3) protruding above the rim (13) and extending slightly toward the center of the mug, over the inner core (4). The tabs (3) serve to hold the inner core (4) within the outer shell (10) while allowing the inner core (4) to rotate relative to the outer shell (10) from a cleaning position (FIG. 1) wherein the flange (7) is aligned with the gap (6), to a consumption position (FIG. 2) wherein the flange (7) is aligned with the wall (22) forming a closed tube. If desired, the tabs (3) may be made small enough to allow the inner core (4) to be inserted into and removed from the outer shell (10) by the user, or they may be formed after initial assembly to be large enough to permanently lock the inner core (4) in place within the outer shell (10).

When aligned for consumption (FIG. 2), tab (1) is moved to the consumption position (29). The cooling flanges (7) are sealed by the walls (22) of the inner core (4). When the user sucks at the tip (2), fluid is drawn from the exposed tubing section (5) at the bottom (24), through the sealed spiral flange (7) up to the tube (2) opening at the top (25). Along the way, the hot fluid radiates heat through the thin tubing into the surrounding air, such that the fluid is less hot when it reaches the mouth.

However, when tab (1) is moved to the cleaning position (28), the gap (6) of the inner core (4) is aligned with the outer shell's (10) cooling flanges (7). In this position, the cooling flanges (7) are completely opened to the interior (23) of the inner core (4), allowing for easy cleaning. The small section of tube (2) at the top is short enough to effectively be cleaned without opening fully.

The container of the invention can also come with a lid (30) to further keep the liquid insulated and hot until consumption and to minimize spills.

The container of the invention addresses the shortcomings noted in prior art in the following ways:

First, it allows immediate and continuous consumption of hot beverages. Upon pouring the hot beverage into the container, the user can suck on the end of the tube (2) at the top of the cup. The liquid is drawn out of the insulated inner core (4) into the external flanges (7) where it is immediately and continuously cooled by the ambient environment while in transit to the end of the tube (2) at the top of the container. There is no waiting for the beverage to cool down in a secondary chamber, and no need to go through a cycle of filling and emptying a cooling chamber.

Second, unlike other straw/cup designs the cup is made easy to clean as one simply twists the inner core (4) relative to the outer shell (10) to expose the tubing. No disassembly is required.

Third, since the invention is formed from two parts (the inner core (4) and outer shell (10)) or three (if the handle (16) is attached separately) it is very cheap and easy to manufacture. No assembly is required aside from attaching a handle if that method is chosen.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

LIST OF REFERENCE NUMBERS

1. Tab
2. Drinking tube
3. Small tabs
4. Inner core
5. Larger gap at bottom of inner core
6. Small gaps in inner core
7. Cooling flanges
8. Insulated wall of outer shell
9. Central chamber of outer shell
10. Outer shell
11. Stabilizing rod of rigid material
12. Material connecting the top portion of the inner core with the final ring
13. Rim of container
14. Point where the dual cooling flanges join single tube
16. Handle
20. Open top of inner core
21. Bottom of inner core
22. Walls of inner core
23. Central chamber of inner core
24. Bottom of outer shell
25. Top of outer shell
26. and 27. divisions of flange (7)
28. Tab (1) in consumption position
29. Tab (1) in cleaning position
30. Lid
31. Inner surface of inner core
32. Outer surface of inner core

What is claimed is:

1. A beverage container comprising:

a) an inner core, comprising:

a body having a top, a bottom, and side walls with an inner surface forming a central chamber for fluids and a cylindrical outer surface having a circumference, the side walls of the inner core being pierced by a spiral groove running from the inner surface through the walls adjacent the bottom to adjacent the top;

the spiral groove ending at a large portion adjacent the bottom of the body of the inner core; and b) an outer shell surrounding the inner core, comprising:

a body having a top, a bottom, and side walls having an outer surface and an inner surface enclosing a cylindrical central chamber having a circumference fitting tightly to the cylindrical outer surface of the inner core;

at least one uninsulated cooling flange forming a spiral on the outer surface of the outer shell, having an outside for heat conduction to the atmosphere and an open inside penetrating the side walls of the outer shell from adjacent the bottom to adjacent the top; and c) a drinking tube fluidly coupled to the at least one cooling flange adjacent to the top of the outer shell, extending away from the container;

the spiral formed by the at least one cooling flange and the spiral groove of the inner core being matched such that:

when the inner core is rotated to a cleaning position relative to the outer shell, the open inside of the at least one cooling flange aligns with the spiral gap in the inner core, and when the inner core is rotated to a consumption position relative to the outer shell, the open inside of the at least one cooling flange aligns with the outer surface of the inner core, sealing the open inside of the at least one cooling flange except at the large portion of the spiral groove of the inner core, and forming a continuous channel from the central chamber to the drinking tube, so that a user may drink through the drinking tube, drawing fluid from the central chamber through the larger portion of the spiral gap into the at least one cooling flange, and then into the drinking tube.

2. The beverage container of claim 1 further comprising an insulating lid over the top of at least the inner core.

3. The beverage container of claim 1 in which the outer shell is made of insulating material.

4. The beverage container of claim 1, in which the inner core is made of insulating material.

5. The beverage container of claim 1, further comprising a handle fastened to the outer shell.

6. The beverage container of claim 1, further comprising at least one tab extending radially outward from the top of the inner core.

7. The beverage container of claim 1, further comprising at least one tab extending radially inward from the top of the outer shell.

8. The beverage container of claim 1, in which the at least one outer flange is divided into at least two tubes over at least part of a length of the flange, the tubes being combined into a single tube before being coupled into the drinking tube.

9. The beverage container of claim 1, further comprising at least one reinforcing rod inside the central chamber of the inner core, connected to the inside surface thereof.

* * * * *